United States Patent [19]

Pellegri

[11] 4,417,960

[45] Nov. 29, 1983

[54] NOVEL ELECTROLYZER AND PROCESS

[75] Inventor: Alberto Pellegri, Luino, Italy

[73] Assignee: Oronzio de Nora Impianti Elettrochimici S.p.A., Milan, Italy

[21] Appl. No.: 222,958

[22] Filed: Jan. 6, 1981

Related U.S. Application Data

[62] Division of Ser. No. 128,972, Mar. 10, 1980, Pat. No. 4,279,731.

[30] Foreign Application Priority Data

Nov. 29, 1979 [IT] Italy ..... 27690 A/79

[51] Int. Cl.[3] ..... C25B 1/34

[52] U.S. Cl. ..... 204/98; 204/128

[58] Field of Search ..... 204/98, 128, 254–256, 204/263, 266, 253, 283

[56] References Cited

U.S. PATENT DOCUMENTS

| | | | |
|---|---|---|---|
| 3,941,675 | 3/1976 | Strasser et al. | 204/256 |
| 4,013,525 | 3/1977 | Emsley | 204/98 |
| 4,059,500 | 11/1977 | Kamarian | 204/256 |

FOREIGN PATENT DOCUMENTS

| | | | |
|---|---|---|---|
| 242601 | 5/1946 | Switzerland | 204/256 |
| 242830 | 6/1946 | Switzerland | 204/256 |
| 255873 | 7/1948 | Switzerland | 204/256 |

*Primary Examiner*—R. L. Andrews

*Attorney, Agent, or Firm*—Hammond & Littell, Weissenberger and Muserlian

[57] ABSTRACT

A bipolar diaphragm or membrane electrolyzer comprising a housing containing an end anode element, an end cathode element and a plurality of bipolar elements with their major dimensions lying in a substantially vertical plane and comprised of a bipolar wall separating the anode compartment and the cathode compartment and vertical foraminous electrodes parallel positioned a certain distance from the bipolar wall, diaphragms or membranes separating the anodes and cathodes, a series of baffles distributed along the entire width of the electrode compartment and extending from the bipolar wall to the foraminous electrode to form a series of vertical flow channels extending over a large portion of the height of the wall, the said baffles being alternately inclined one way and the other way with respect to the vertical plane normal to the bipolar wall plane and spaced from one another whereby the ratio of the electrode surface intercepted by the edges of two baffles laterally defining a vertical flow channel to the flow section thereof is different from the ratio of the electrode surface intercepted by the edge of one of said two baffles and the edge of the adjacent baffle in the series and the flow section of the adjacent channel in the series to the said vertical flow channel, novel bipolar elements and improved methods of electrolysis.

10 Claims, 8 Drawing Figures

FIG. 6A
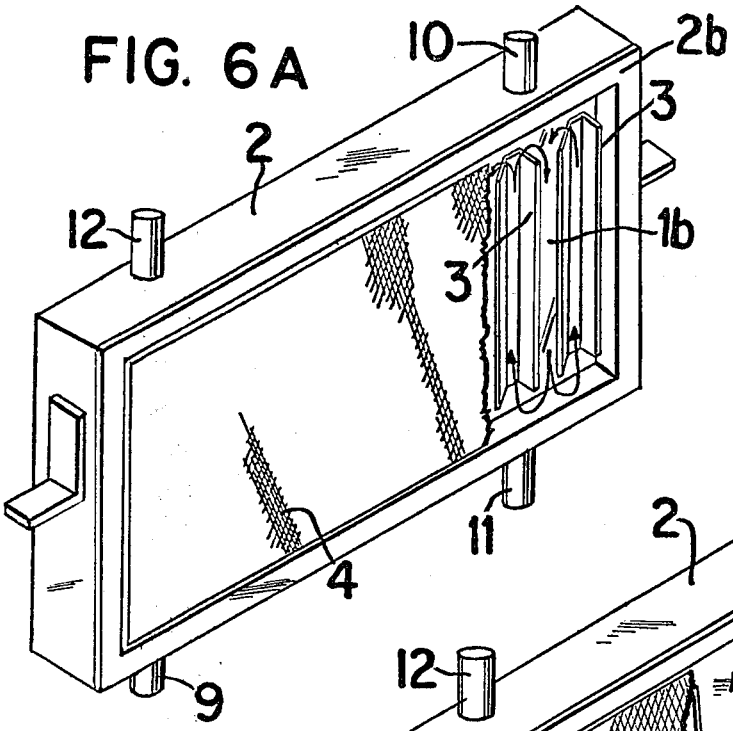
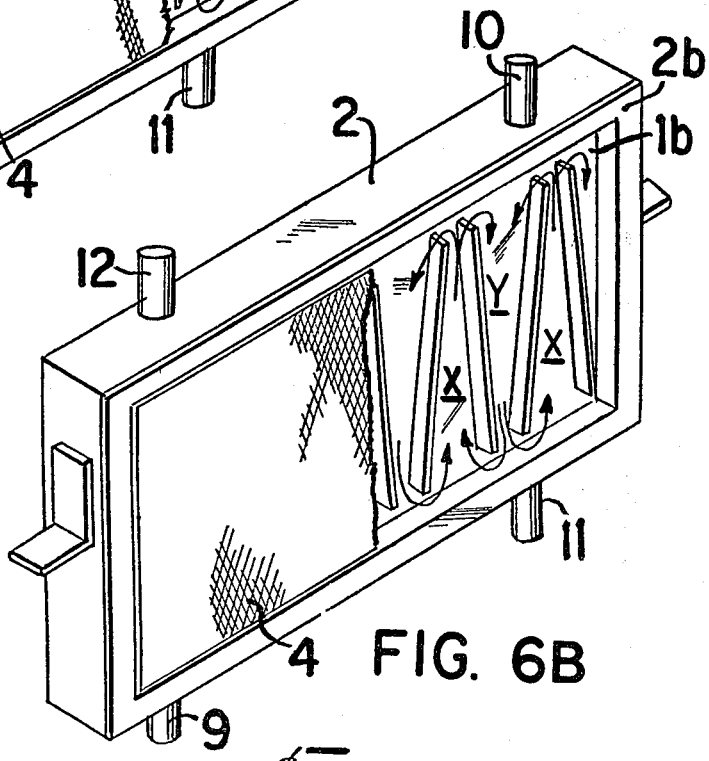
FIG. 6B
FIG. 7
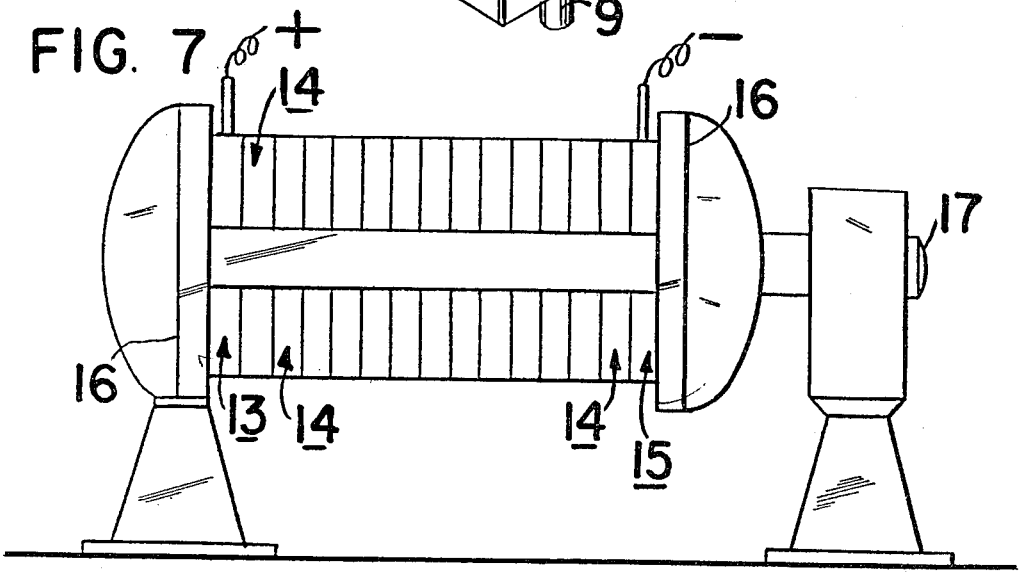

NOVEL ELECTROLYZER AND PROCESS

This application is a divisional application of my copending, commonly assigned U.S. patent application Ser. No. 128,972 filed Mar. 10, 1980, now U.S. Pat. No. 4,279,731.

STATE OF THE ART

Chlorine and alkali metals hydroxides such as sodium hydroxide and potassium hydroxide are largely used commodities in every industrialized country and they are almost exclusively obtained by electrolysis of aqueous solutions of alkali metals chlorides, with a large share of the production coming from plants equipped with diaphragm or membrane cells. With the advent of dimensionally stable materials of construction, the so called filter-press arrangement has become the most preferred one for diaphragm or membrane cells.

An electrolyzer of this type comprises a series of vertical bipolar elements comprising a bipolar separating wall carrying on one side thereof the cathode structure and on the other side the anode structure with membranes or diaphragms positioned between the anode structure of one bipolar element and the cathode structure of the bipolar element adjacent in the series. The electrolyzer also comprises an anode and cathode end plate at the two ends of the series connected to the respective poles of the current source.

The bipolar plate or wall performs multiple functions. As a matter of fact, its acts as the end plate of the respective electrode compartment and electrically connects the cathode on one side of the bipolar element to the anode on the other side thereof and a frame, often integral with the bipolar wall, provides seal surfaces around the electrode compartments. The electrodes are generally comprised of screens or expanded sheets or otherwise foraminated sheets, supported by ribs or connectors onto the respective surfaces of the bipolar wall in a parallel and spaced apart relationship therewith. The electrodes are often made co-planar with the frame's seal surfaces and the interelectrodic gap, as well as the distance of the electrodes from the diaphragm therebetween, is often determined by interposed gaskets of a suitable thickness between the frame's seal surfaces and the diaphragm.

The frame of each bipolar element is provided with the necessary inlet and outlet ports for the electrolytes and the electrolysis products so that the electrolyte feeding, as well as products recovery, are individually carried out to and from each electrode compartment, that is in parallel mode with the aid of distributors and collectors which may be external to the electrolyzer or may be internal ducts obtained by suitable drilling coaxial holes through the frame thickness.

Obvious considerations from a technical and economical stand-point have confirmed the desirability of cells characterized by high electrodic surfaces and minimum width of electrode compartments with parallel feeding thereto with distributors and collectors, both of the internal or of the external type. A first technical consideration concerns the power supply of the bipolar electrolyzers which consist of a large number of unit cells in series and therefore require power supply voltages on the order of hundreds of volts at their terminals. Considering the reverse voltage limits of modern silicon rectifiers, each rectifier circuit cannot feed more than a certain number of electrolyzers in series. It is, therefore, desirable that the electrode surfaces be as large as possible for an acceptable ratio between the cost of a rectifying circuit and the production capacity of the electrolyzers.

On the other hand, considerations of compactness and the necessity of saving expensive construction materials require that the bipolar elements be as thin as possible to reduce the thickness or width of the electrode compartments to a minimum. Therefore, modern electrolyzers are produced with electrode surfaces of more than 2 $m^2$ high and with electrode compartment depths on the order of a few centimeters.

These cell geometries, although optimal under various aspects, raise a problem with respect to uniformity of operation over the entire cell's surface and this problem is rendered even more serious by the desirability of conducting the electrolysis at high current densities for obvious economical reasons. For example, in the electrolysis of sodium chloride brine in an electrolyzer of the type described above equipped with a semi-permeable diaphragm such as a cationic membrane, the nearly saturated brine is fed to each anode compartment though an inlet port generally near the bottom of the compartment. The spent brine, together with the chlorine gas evolved at the anode, leaves the cell through an oulet port near the top of the anode compartment and is collected in a manifold through which, after separation from the chlorine, it is either fed back to the saturation/-purification stage, or partially recycled to the anode compartment together with fresh saturated brine from the saturation/purification stage.

Sodium ions migrate across the membrane to the cathode compartment, wherein evolution of hydrogen and sodium hydroxide formation take place at the cathode. The cathode compartment is fed with water or dilute sodium hydroxide solution while hydrogen gas and concentrated caustic are recovered. The well-known kinetic problems relating to the diffusive transfer of chloride ions to the active surface of the anode across the anodic double layer would normally dictate a high chloride ion concentration in the anolyte and a great turbulence, that is a high impingement speed, of the anolyte along the anode surface to reduce the side-evolution of oxygen as a result of direct water electrolysis. But, because of the high surface extension of the anode with respect to the depth of the anode compartments, it is difficult and expensive, in terms of pumping capacity, to provide such a high and uniform circulation speed of the anolyte which in practice is stagnant within the anode compartment. To partially overcome the lack of circulation speed, it is customary to maintain a high chloride ions concentration in the anolyte either by continuous resaturation of the depleted brine withdrawn from the anode compartment or by addition of hydrochloric acid.

In practice, however, this hardly ensures the uniformity of conditions all over the anode surface and furthermore entails higher costs in terms of greater capacities of the brine saturation and purification facilities. Oxygen evolution is still likely to occur because of concentration gradients within the anolyte, especially in areas where the anolyte is more depleted of chloride ions. Such a side-reaction, besides entailing a loss of current efficiency, has a detrimental effect on the active life of the anodes which rapidly lose their catalytic activity when oxygen is evolved. On the other hand, cation exchange membranes and, though a lesser extent, the traditional porous diaphragms are particularly sensitive to the caustic concentration on the cathode side. For this reason, it is also highly advisable to maintain the concentration of the caustic in contact with the diaphragm within a well-defined range and, above all, to prevent the occurrence of the concentration gradients along the entire surface extension of the cathode side of the diaphragm.

OBJECTS OF THE INVENTION

It is therefore an object of the invention to provide an improved method of electrolysis of aqueous halide solutions in bipolar electrolyzers of the diaphragm type equipped with vertical electrodes whereby multiple recirculation motions are generated in the electrolyte and are uniformly distributed all over the electrode surface.

It is a further object of the invention to provide a novel, improved diaphragm bipolar, electrolyzer with vertical electrodes equipped with means to generate an internal recirculation of the electrolyte within the compartment and to provide novel bipolar elements.

It is another object of the invention to provide a new and improved method of electrically connecting the electrodes of each bipolar element through the bipolar separator.

These and other objects and advantages of the present invention will become obvious from the ensuing description thereof.

THE INVENTION

The novel bipolar diaphragm or membrane electrolyzer of the invention comprises a housing containing an end anode element, an end cathode element and a plurality of bipolar elements with their major dimensions lying in a substantially vertical plane and comprised of a bipolar wall separating the anode compartment and the cathode compartment and vertical foraminous electrodes parallel positioned a certain distance from the bipolar wall, diaphragms or membranes separating the anodes and cathodes, a series of baffles distributed along the entire width of the electrode compartment and extending from the bipolar wall to the foraminous electrode to form a series of vertical flow channels extending over a large portion of the height of the wall, the said baffles being alternately inclined one way and the other way with respect to the vertical plane normal to the bipolar wall plane and spaced from one another whereby the ratio of the electrode surface intercepted by the edges of two baffles laterally defining a vertical flow channel to the flow section thereof is different from the ratio of the electrode surface intercepted by the edge of one of said two baffles and the edge of the adjacent baffle in the series and the flow section of the adjacent channel in the series to the said vertical flow channel.

By providing a series of baffles extending for about the entire eight of the electrode compartment and with a width substantially equal to the depth thereof, that is corresponding to the distance between the bipolar separator and the electrode metal screen, and being said baffles alternately slanted one way and the opposite with respect to the vertical plane normal to the surface of the separator and the electrode, the entire compartment flow section is divided into a series of vertically oriented flow channels and the baffles' edges adjacent to the electrode screen intercept (or divide) the entire electrode surface into a series of areas; by making the ratio between the area of the electrode surface intercepted by two adjacent baffles and the flow section of the corresponding vertical channel different from the ratio between the electrode area intercepted by one of the two baffles and another baffle adjacent thereto and the flow section of the corresponding vertical channel adjacent to the former, multiple recirculation motions of the electrolyte are generated, effectively involving the entire electrolyte body within the compartment, however wide it may be. As a matter of fact, wherever gas evolution occurs at the screen electrode surface substantially contacting the diaphragm or membrane, gas bubbles are released through the mesh of the screen electrode and rise through the electrolyte. The baffles are effective in forcing the stream of bubbles evolved from the electrode surface intercepted by the edges of the two baffles to rise within the electrolyte body included in the vertical channel laterally defined by said baffles.

If, alternately, a large portion of intercepted electrode surface corresponds to a small flow section and vice-versa for the channel adjacent in the series, the density of gas bubbles in the former channel is high whereas in the latter channel adjacent thereto, the gas bubble density is far lower. Therefore, by virtue of the difference in magnitude of the viscous interaction forces between the rising gas bubbles and the liquid, the electrolyte in the first channel is dragged upwards inducing a downward motion in the electrolyte contained in the adjacent canal. An unlimited series of recirculation motions can thus be generated uniformly along an extension, however ample, of the electrode surface involving the entire electrolyte body within the compartment.

The baffles can consist of any inert material resistant to the electrolyte and the electrolysis products but more desirably they act as the current-carrying and supporting means for the foraminous electrode structure.

Some preferred embodiments of the invention are hereinbelow described with reference to exemplifying drawings and examples which are not, however, intended to illustrate all possible forms and modifications within the scope of the invention.

Referring to the drawings:

FIGS. 6A and 6B are perspective views from the anode side of a bipolar element of an electrolyzer of the invention;

FIG. 7 is a side elevation view of an assembled bipolar electrolyzer of the invention.

Figure 1:
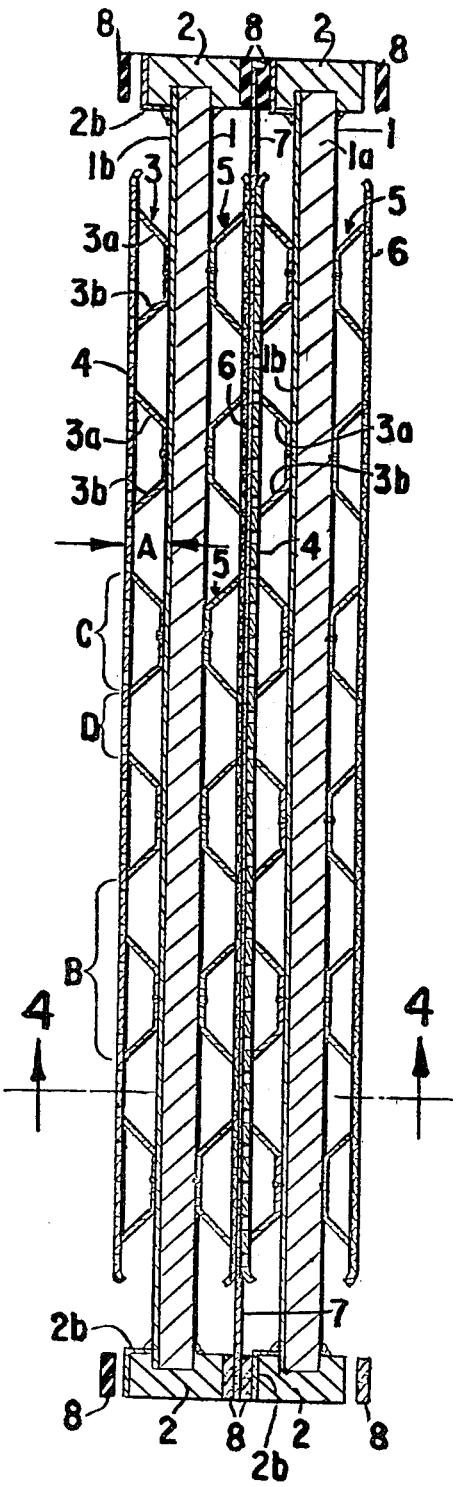
FIG. 1 is a plan view of two bipolar elements of the bipolar diaphragm electrolyzer according to a preferred embodiment of the invention.
Figure 2:
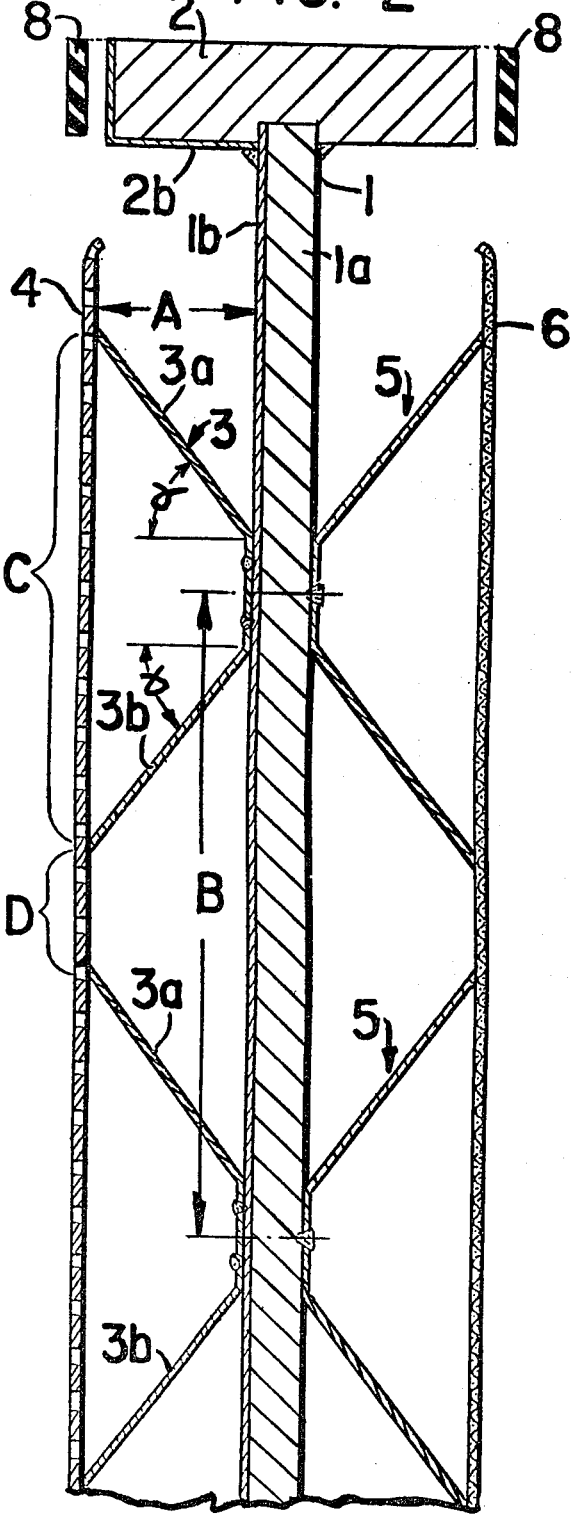
FIG. 2 is a magnified portion of the upper part of FIG. 1.

Referring to FIG. 1 which illustrates two bipolar elements representative of a series of elements comprising a bipolar diaphragm electrolyzer suitable for the electrolysis of sodium chloride brine and FIG. 2 which is a magnified detail thereof, each bipolar element is comprised of a bipolar wall or partition 1 which wall is a bimetal, preferably obtained by explosion-bonding and/or lamination. The said bimetal comprises a plate of steel or other suitable cathode material 1*a* about 7 to 15 mm thick and a titanium or other valve metal sheet 1*b* about 1 to 2.5 mm thick. The rectangular frame is made of welded steel bars 2 about 15 to 30 mm thick. The frame surfaces defining the anode compartment are clad with titanium or other valve metal sheet 2*b* sealably welded to the titanium or valve metal sheet 1*b* of the bipolar wall.

Trapezoidal channels 3 of titanium sheet, with a thickness preferably in the range of 1.5 to 3 mm, are preferably welded through slots or holes punched on the bottom of the channels on the titanium sheet 1*b*. The channels extend vertically for almost the entire height of the anode compartment ending a certain distance (on the order of a few centimeters, preferably greater than at least 3 cm) from the frame inner surface. The channels are uniformly positioned a certain distance from one another for the entire width of the anode compartment.

The anode is comprised of a screen or expanded sheet 4 of titanium or other valve metal suitably coated with a layer of resistant, non-passivatable material such as described in U.S. Pat. Nos. 3,711,385 and 3,778,307. Suitable anodic coatings may comprise platinum-group metals oxides, conductive mixed oxides of non-noble metals such as for example perovskites, spinels, etc. The screen or expanded sheet may be welded on the edges of channels 3 which are coplanar, but may also not be welded thereon as will be seen hereinafter from the description.

Depending on the depth of the anodes compartment A, the inclination of the sides 3*a* and 3*b* of the trapezoidal channels 3 and the distance between each channel B are such that the ratio between the portion of anode surface intercepted by the two edges of the sides 3*a* and 3*b* of a channel (labeled as C in FIG. 1) and the flow section area of the channel is different from the ratio between the portion of anode surface intercepted by two sides 3*a* and 3*b* of two adjacent channels (indicated as D in FIG. 1) and the flow section laterally defined by the same two sides 3*a* and 3*b* of the two adjacent channels.

It is unimportant which one of the two cited ratios is the greater, but it is essential that they be different from each other. For this embodiment, one of the two ratios may be from 1.5 to 8 times greater than the other, for example with a channel height of about 1 m, it is preferably from 3 to 5 times greater than the other. According to the embodiment represented in FIGS. 1 and 2, the anode Area C/Flow Section Area of Channels 3 ratio is three times greater than the ratio between the Anode Area D and the Flow Section Area between the two adjacent Channels 3.

As substantially described for the anode side of the bipolar element, trapezoidal channels 5 with a thickness preferably in the range of 1.5–3 mm and consisting of a sheet of steel, nickel or other material resistant to caustic and hydrogen are welded on to the steel sheet 1*a* of the bipolar element, preferably in direct opposition to the corresponding anode channels 3. Also in this case, the trapezoidal channels 5 extend vertically for almost the entire height of the cathode compartment ending at 3 cm from the inner surface of the frame. The cathode consists of a screen or expanded sheet 6 of steel, nickel or other material resistant to caustic and hydrogen. The screen or expanded sheet cathode may be welded, although not necessarily so, on to the co-planar edges of the inclined sides of the trapezoidal channels 5.

The ratios between the portions of intercepted cathode surface and the corresponding flow sections, as described for the anode side may differ by a factor varying between 1.5 and 8. For example, with a height of the cathode compartment of about 1 m, the factor is more preferably between 3 and 5.

The bipolar elements are assembled by means of tie-rods or hydraulic or pneumatic jacks between two monopolar terminal anodic and cathodic elements to form electrolyzers of high capacity.

As illustrated in FIG. 1, a diaphragm 7 is positioned between the anode screen of a bipolar element and the cathode screen of the adjacent bipolar element in the series and it is preferably a cation-permeable membrane, substantially impervious to gas and liquid hydrodynamic flow. One type of suitable membrane consists of a thin film of tetrafluoroethylene/perfluorosulfonylethoxyvinyl ether copolymer with a thickness of a few tenths of millimeters produced by du Pont de Nemours under the tradename of Nafion. Proper gaskets 8 are provided between the seal surface of the frames 2 and the membrane 7.

Preferably, both the anode screen 4 and the cathode screen 6 almost contact the membrane 7 after the assembly of the cell, but they may be spaced a certain distance from the membrane surface, generally not greater than 2 mm. Both the anode and the cathode may consist of porous layers of particles of an electroconductive, electrochemically resistant material bonded and embedded on the respective sides of membrane 7, for example by hot-pressing. In this instance, the foraminous anode and cathode screens 4 and 6, respectively, act as current distributor and collector for the electrodes bonded on the membrane surfaces. The electrical contact between the electrodes and the respective distributors and collectors is provided and maintained by mechanical pressure with anode and cathode screens 4 and 6 exerting a pressure in the range of 100–1000 g/cm$^2$ against the surface of the membrane bearing the electrodes bonded thereon.

When the anode and cathode screens 4 and 6 are pressed against membrane 7 when assembling the electrolyzer, they need not be welded onto the co-planar edges of the channels 3 and 5, but they may preferably merely rest thereon. The clamping pressure is sufficient to provide a good electrical contact between the edges of the channels and the electrode screens. Furthermore, the lack of welding points does not constrain the inclined sides of the channels 3 and 5 and therefore, the structure is characterized by a certain eleasticity whereby the inclined sides of the channels can slightly bend, thus compensating within certain limits, for small deviations from the planarity and parallelism between the anode and the cathode screens. Therefore, baffles 3*a* and 3*b* of the anode channels 3 and the baffles representing the inclined sides of the cathode channels 5, besides acting as hydrodynamic means, are the current distributing means to the electrodes of the cell resulting from the assembling of the desired number of bipolar elements.

Figure 3:
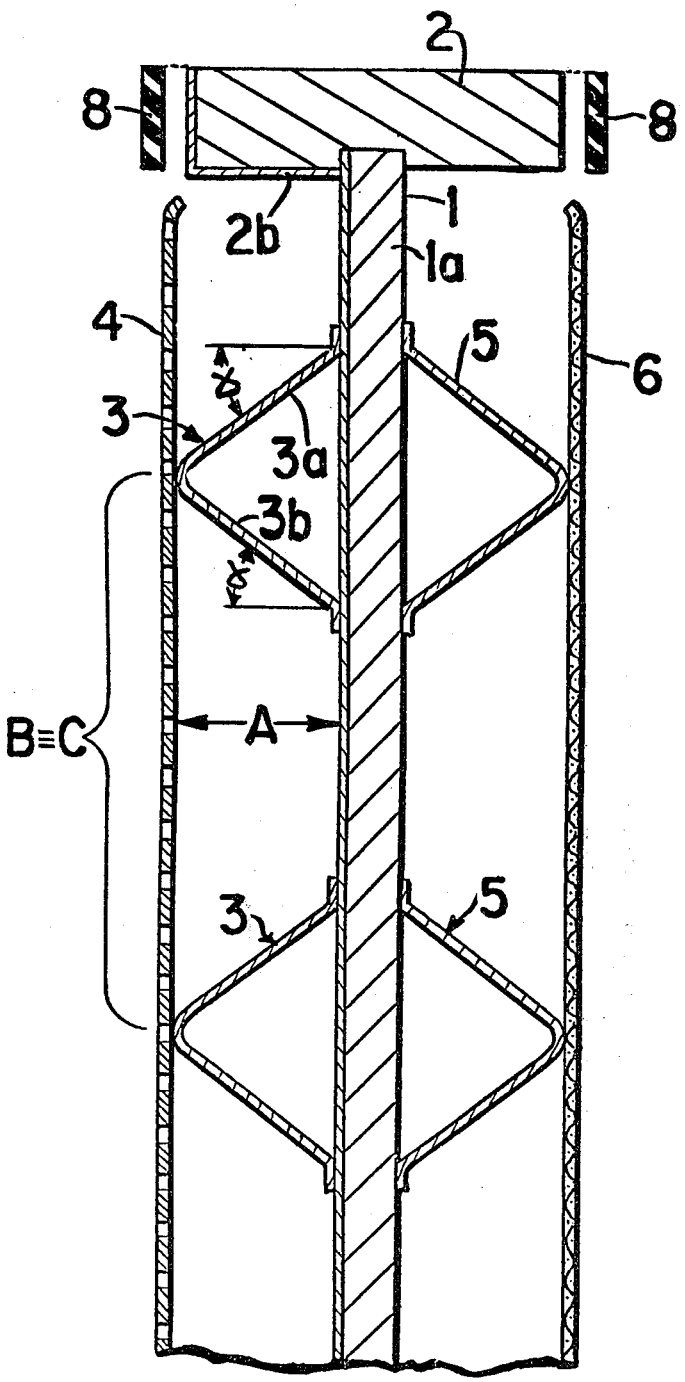
FIG. 3 is a partial plan view of a bipolar element of a bipolar diaphragm electrolyzer according to another embodiment of the invention.

FIG. 3 illustrates a different embodiment of the electrolyzer of the invention wherein the parts performing the same functions are labeled with the same numbers as in FIGS. 1 and 2. In this embodiment, the channels are built by welding a series of V-section channels onto the two sides of bipolar partition 1 and unlike FIGS. 1 and 2, the electrical contact with the screen electrodes occurs at the vertex of the V-section channels. The rigidity of the contact points provided by the channels welded along their respective free edges to the surface of the bipolar partition makes the electrical welding of the electrode screens to the channels' vertexes easier and this construction may be preferred in the case wherein electrodes 4 and 6 are to be spaced from membrane 7 and wherein the electrodes must be welded on the channels.

Also in this instance, the ratio between the portion of electrode surface intercepted by the two edges of a channel and the flow section thereof is different from the ratio between the portion of electrode surface between two adjacent channels and the flow section therebetween. In this particular case, the portion of electrode surface intercepted by the two edges of a channel is substantially equal to zero and therefore the essential requirement that the two ratios be different is fulfilled. As will be obvious from FIG. 3, the various flow channels may be formed by welding, instead of a series of individual channels, a suitably corrugated sheet onto the surface of the bipolar partition.

Figure 4:
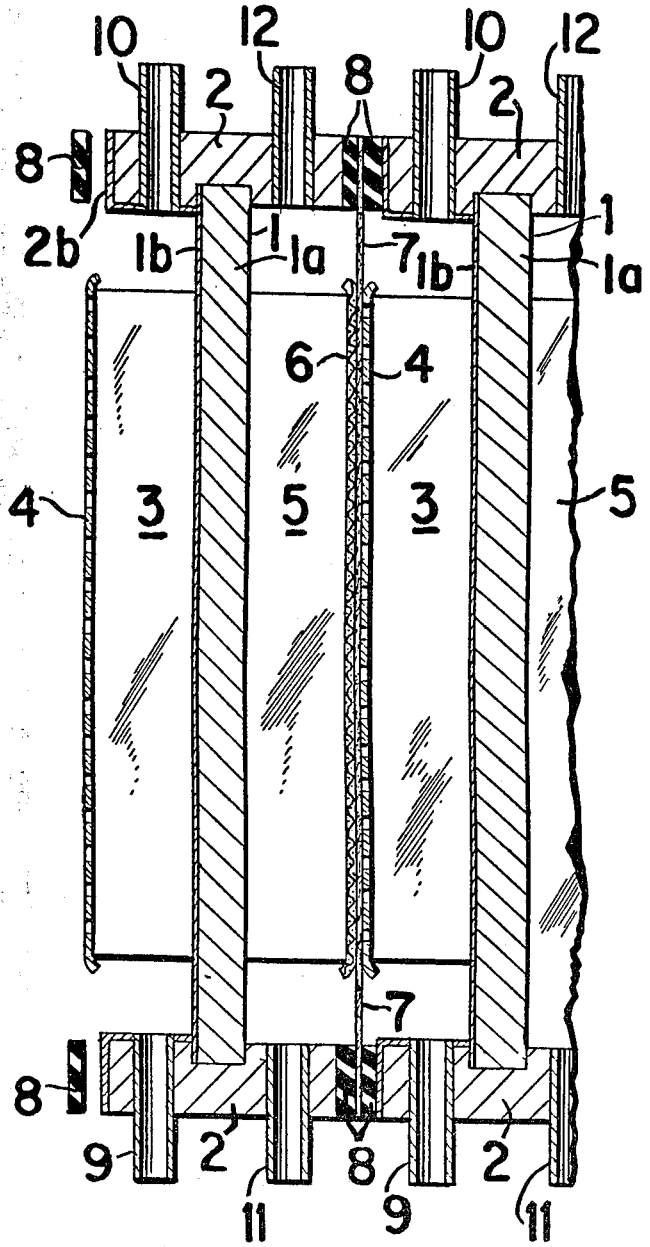
FIG. 4 is an elevation view of FIG. 1 taken along line IV—IV.

FIG. 4 is an elevation view of the bipolar elements of FIG. 1 along section line IV—IV. On the bottom of the anode compartments, there is provided an anolyte inlet 9, while an outlet 10 for the spent anolyte and the anodic gas is provided on the upper side of the frame. The cathode compartments are likewise provided with an inlet 11 for water or dilute caustic and an outlet 12 for concentrated caustic and hydrogen.

During the operation of the electrolyzer, electrolysis current passes through the whole series of elementary cells from the anodic terminal element, across each bipolar element from the cathode screen of an elementary cell through the cathode ribs, the bipolar separator, the anode ribs and the anode screen of the adjacent elementary cell, and so forth and so forth to the cathodic terminal element. Chlorine gas is evolved at the anode in the form of tiny bubbles passing through the mesh of the anode screen and rising through the brine within the anodic compartment. Solvated sodium ions migrate across the membrane and reach the cathode surface where they combine with the hydroxyl ions generated by the cathodic reduction of water to form caustic. The cathode-evolved hydrogen in the shape of tiny bubbles passes through the mesh of the cathode screen and rises through the catholyte in the cathode chamber.

Referring to FIGS. 1 and 2, the amount of chlorine evolved at the anode surface corresponding to the segment labeled C is forced to rise through the section of channel 3, while the amount of chlorine evolved at the anode surface corresponding to the segment labeled D is forced to rise through the section of the flow channel defined by the walls 3*a* and 3*b* of two adjacent channels 3. As the ratios between the amount of chlorine (that is anode surface) and the flow section are different in the two cases, in particular the first being much greater than the second, the anolyte within channel 3 is pushed upwards because of the high density of gas bubbles and this upwards motion induces a downwards motion of the electrolyte outside channel 3, the gas bubble density therein being much lower. Therefore, multiple recirculation motions adjacent one another are generated along the entire width of the anode compartment, thus generating a continuous recycling of the whole body of anolyte. Concentrated brine fed in at the bottom of the anode compartment through inlet 9 is then immediately circulated whereby concentration gradients are prevented from occuring and a more uniform operation is assured all over the anode surface.

Most of the chlorine gas bubbles leave the compartment through outlet 10 at the top surface (see FIG. 4) together with the spent anolyte corresponding to the volume of concentrated brine fed at the bottom of the compartment. Hydrogen bubbles produce substantially the same effect in the catholyte. The water or dilute caustic fed in at the base of the cathode compartment through inlet 11 (see FIG. 4) is immediately circulated thereby preventing the establishment of concentration gradients and assuring proper caustic concentration all over the cathode surface. Moreover, the high catholyte speed along the cathode screen 6 is effective in providing a more rapid dilution of the strongly alkaline film formed on the cathode surface.

Figure 5:
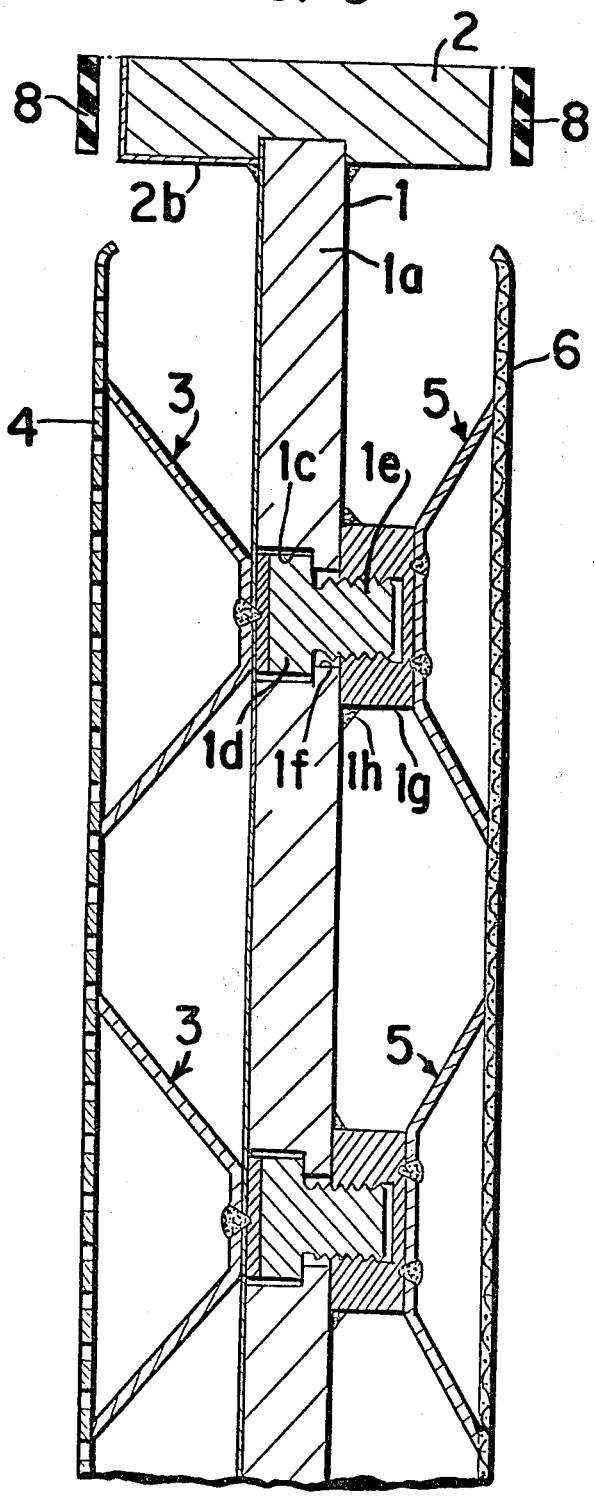
FIG. 5 is a magnified partial detail of a plan view of a bipolar element characterizing the bipolar diaphragm electrolyzer according to a further preferred embodiment of the invention.

FIG. 5 illustrates the method of the present invention by effecting the electrical connection between the cathode and the anode of each bipolar element through the bipolar separator and the baffles inclined with respect to the normal plane, the separator and the electrodes. FIG. 5 is a magnified detail of a plan section of a bipolar element of the invention and assembled as follows.

In a steel or other suitable cathodic material plate, there are provided a series of grooves 1*c* parallel and equidistant from one another and extending for almost the entire height of the plate and ending a few centimeters from the upper and lower edges thereof. From a bimetal plate (titanium 1–2 mm thick, copper 4–10 mm thick), strips 1*d* are cut with a width preferably from 1 to 3 cm and a length similar to that of the grooves 1*c*. One or more threaded copper stems are welded with an uniform spacing onto the copper side of the bimetal strips 1*d*.

The strips are then inserted into the grooves 1*c* and the threaded copper stems pass through the holes if drilled through the bottom of the grooves 1*c*. Cap nuts 1*g* of steel or other proper cathodic material are screwed onto the threaded copper stems 1*c*. A gasket or preferably as indicated in FIG. 5, a weld 1*h* provides the hydraulic seal. A thin sheet of titanium or other valve metal 1*b* is positioned on the surface of the sheet 1*a*. The titanium sheet is preferably provided with a series of holes or slits engaging the bimetal strips 1*d* and the channels 3 are provided with slits or holes coaxial with the slits or holes of sheet 1*b*.

In correspondence to the welding holes or slits, both the channels 3 and the sheet 1*b* are welded in a single operation to the titanium side of the Ti-Cu bimetal strips 1*d*. On the cathode side, the channels 5 are welded onto the cap nuts 1*g*. The bipolar element may be finally completed by frame 2 provided with the necessary inlets and outlets by the titanium cladding 2*d* sealably welded on the titanium sheet 1*b* and by the anode screen 4 and the cathode screen 6.

Electric current flows from the cathode screen 6, through the inclined cathode ribs 5, the nuts 1*g*, the threaded copper stems 1*e* and is distributed by the copper bar of the bimetal strip 1*d* to the inclined anode ribs forming the walls of the titanium channels 3 through a series of welding points connecting the titanium channels 3 and the titanium sheet 1*b* to the titanium side of the bimetal strip 1*d*. The assembly disclosed in FIG. 5 entails outstanding advantages over the use of expensive bimetal plates made of valve metal/steel.

An effective and minimum amount of bimetal (valve metal/copper) is required with a remarkable saving of costs. Moreover, very thin titanium or other valve metal sheets may be used as the anode cladding sheet 1*b* with a thickness preferably less than 1 mm since the welding of the anode channels 3 is effected on the valve metal side of the bimetal strips. When bimetal plates are used, the titanium or other valve metal thickness must be sufficient to allow the welding of the anode channel 3 without damaging the valve metal cladding and therefore, the valve metal thickness must be at least 1 mm and preferably not less than 1.5 mm. The advantage of the assembly of the invention is evident also in terms of lesser amounts of valve metal to be used.

A further outstanding advantage resides in the electrical current being substantially carried by copper through the bipolar separator whereby the ohmic losses therethrough are kept to a minimum. The copper also acts as a barrier material against the diffusion of atomic hydrogen from the cathode surfaces of steel, notably an atomic hydrogen permeable material, to the titanium constituting the anode cladding and the anode channels. The thickness of the copper barrier is more than sufficient to practically keep the hydrogen from migrating to the valve metal at the welding points of the anode channels on the valve metal side of the bimetal strips, thus avoiding embrittlement due to the combination of atomic hydrogen with the valve metal.

FIG. 6A is a perspective view of a bipolar element of the invention as seen from the anode side. Also in this drawing, the same numbers label the same elements as described with reference to the above figures. The anode compartment defined by the inner surfaces of the frame 2, the valve metal-clad surface of the bipolar separator 1*b* and the anode mesh structure 4, is completely separated from the cathode compartment on the other side of the bipolar separator. The anode baffles represented by the inclined walls of the valve metal channels 3 divide the anode compartment into a series of vertical flow channels wherein, as a result of an alternatively different proportion of intercepted gas ascending along the respective flow channels, the recirculation motions schematically represented by arrows are generated.

FIG. 6B is a perspective view from the anode side of a bipolar elment of a different embodiment of the invention and the baffles may also be alternately inclined one way and the other with respect to the vertical plane normal to the bipolar separator surface, in the other direction, that is longitudinally instead of transversally. In other words, they may extend from the surface of the bipolar separator normally thereto, although being alternately inclined one way and the other with respect to the vertical plane normal to the separator surface. In this way, the vertical flow channels turn out to have a rectangular section alternately increasing and decreasing along an upward direction. Also in this instance, the gas intercepted by the baffles laterally defining a channel is formed to pass through a flow area which is different from the flow area of an adjacent channel whereby a different gas bubble density is established in the two adjacent channels. This generates an upward motion of the electrolyte within the channel with the higher gas bubble density and at the same time, a downward motion of the electrolyte is generated in the adjacent channel.

The anode baffles 3 extend from the bipolar separator to the anode screen 4 in a direction normal to the two surfaces thereof and are alternately inclined one way and the other longitudinally with respect to the vertical plane normal to the two surfaces. Therefore, a series of vertical flow channels with an alternately upwards decreasing or increasing section are created along the entire width of the compartment. For example, the vertical channel X has an upwards decreasing section, whereas the adjacent channel Y has an upwards-increasing section. The gas developed at the anode screen 4 passes through the mesh of the screen and is intercepted by the baffles on its way up. Considering the respective flow sections of the two channels at a certain height, a high gas bubble density is present in the electrolyte within channel X, whereas a much lower density is observed in channel Y, as the electrode area thereof, that is the amount of intercepted gas, is much smaller than that of channel X. The electrolyte within channel X is therefore driven upwards, whereas a corresponding volume of electrolyte is recalled downwards in channel Y. In this way, recirculation motions are generated as schematically depicted by the arrows in the Fig.

FIG. 7 is a schematic elevation view of a bipolar electrolyzer of the invention where the electrolyzer consists of an anodic terminal element 13 connected to the positive pole of the electrical source and the anodic end element comprises a signel anode compartment and an anode structure similar to those of the bipolar elements described with reference to the proceeding figures. A certain number of bipolar elements 14, similar to those described above form as many cell units electrically connected in series and the electrolyzer is then completed by the cathodic end element 15 connected to the negative pole of the electrical source. The cathodic end element comprises a single cathodic compartment and a cathode co-operating with the anode of the last bipolar element. The filter press electrolyzer may be assembled with the aid of two clamping plates 16 by means of tie rods or, as illustrated in the drawing with a hydraulic or pneumatic jack.

In the following examples there are described several preferred embodiments to illustrate the invention. However, it is to be understood that the invention is not intended to be limited to the specific embodiments.

EXAMPLE 1

An electrolyzer of the invention with the configuration illustrated in FIG. 1 was characterized by the following geometrical parameters:

depth of anode compartment: 2 cm
depth of cathode compartment: 2 cm
height of compartments: 100 cm
width of compartments: 150 cm
vertical extension of channels (3 and 5) 90 cm
ratio of the respective ratios between the intercepted electrode area and the flow section area of two adjacent flow channels: 3.5

Two bipolar elements were inserted between the anode and cathode end elements in an assembly comprising three elementary cell units. The diaphragm consisted of a Nafion 227-type cationic membrane produced by du Pont de Nemours. Brine containing 300 g/l of sodium chloride and acidified with HCl to a pH of 3.5 was fed to the bottom of the anode compartments with no provision for anolyte recirculation from the outside. Water was meanwhile fed to the bottom of the cathode compartments. The operating conditions were the following:

temperature: 90° C.
current density: 2500 A/m$^2$
anolyte concentration at the outlet of anode compartments: 160 g/l
catholyte concentration at the outlet of cathode compartments: 20%

The cell voltage was 3.9 V and the cathode current efficiency was 93%.

EXAMPLE 2

As a reference, an electrolyzer was used with the same geometrical features as the electrolyzer of Example 1 except for the presence instead of the vertical channels, of as many vertical ribs normal to the separator plane and with a thickness double with respect to that of the sheet forming the channels of Example 1. Also in this case, a Nafion 227-type cationic membrane was positioned between the bipolar elements. Under the same operating conditions, the cell voltage was 4.1 V, while the cathode current efficiency was only 88%.

The flow rate of the concentrated brine fed to the anode compartments was then increased to obtain an increasingly high concentration of the anolyte leaving the anode compartment in an effort to reproduce the voltage and the current efficiency of Example 1. The results are reported in the following table.

| Anolyte Concentration Out from the Anode Compartments g/l | Cell Voltage V | Cathode Current Efficiency % |
|---|---|---|
| 220 | 4.1 | 88 |
| 250 | 4.0 | 89 |
| 280 | 3.9 | 91 |

Then, while maintaining a flow rate so that the concentration of the spent anolyte was 280 g/l, a portion of the catholyte withdrawn from the cathode compartments was continuously recycled to the bottom of the compartments by a recirculation pipe, keeping constant the concentration of the catholyte continuously withdrawn from the system, that is 20% by weight of NaOH. The recycle rate was progressively increased by varying the capacity of the recycle pump. The results are reported in the following Table.

| Catholyte Recycle Rate | Cell Voltage V | Cathode Current Efficiency % |
|---|---|---|
| 2 | 3.9 | 91 |
| 5 | 3.9 | 92 |
| 10 | 3.9 | 92 |

A comparison between the operational data of Example 1 and those of reference Example 2 show the obvious advantages of the invention. Results similar to those of the present method can be obtained only by resorting to expedients entailing exceedingly high costs due to pumping facilities and above all to larger capacities of the plants for the resaturation and purification of brine.

Therefore, the improved method of sodium chloride brine electrolysis in a bipolar diaphragm-type electrolyzer equipped with vertical electrodes comprises: carrying out the electrolysis with electrode compartments substantially filled with electrolyte; dividing the compartments into a series of vertical flow channels extending for almost the entire height of the compartments with a series of baffles of a width substantially corresponding to the depth of the compartment and alternately inclined one way and the other with respect to a vertical plane normal to the plane of the separating wall and spaced apart from one another so that the ratio between the electrode surface (that is the amount of gas) intercepted by the edges of two baffles defining a vertical flow channel and the flow section of the same is different from the ratio between the electrode surface (that is the amount of gas) intercepted by the edge of one of the two baffles mentioned above and the edge of the baffle adjacent thereto in the series and the flow section of the channel adjacent in series to the former channel; feeding concentrated brine at the bottom of the anode compartments and water or dilute caustic preferably to the bottom of the cathode compartments, thereby generating multiple recirculation motions within the entire electrolyte body contained in the compartments, said recirculation motions being distributed along the entire width of the compartments as the result of the different density of the gas bubbles in adjacent channels.

As will be obvious to the skilled artisan, the method of the present invention, whereby efficient recirculation motions are generated within the electrode compartments of bipolar diaphragm-type electrolyzers equipped with vertical electrodes is useful for other electrolysis processes wherein gas evolution takes place, such as for example the electrolysis of water, hydrochloric acid, lithium or potassium chloride. The baffles may also be made of a plastic material and be fitted to existing electrolyzers wherein current distribution to the electrodes is carried out with vertical metal ribs normal to the electrode plane or with distributors of a different shape.

Various other modifications of the apparatus and process of the invention may be made without departing from the spirit or scope thereof and it is to be understood that the invention is intended to be limited only as defined in the appended claims.

What I claim is:

1. A process for the electrolysis of an aqueous solution of an alkali metal halide in a bipolar, diaphragm type electrolyzer equipped with vertical foraminous electrodes comprising carrying out the electrolysis process with electrode compartments substantially filled with electrolyte, dividing said electrode compartments into a series of vertical flow channels extending for a substantial portion of the height of the compartments with a series of baffles of a width substantially corresponding to the depth of the compartment and alternately inclined one way and the opposite with respect to the vertical plane normal to the plane of the separating wall and spaced apart one another, the ratio between the electrode surface intercepted by the edges of two baffles laterally defining a vertical flow channel and the flow section thereof being substantially different from the ratio between the electrode area intercepted by the edge of one of said baffles and of the one adjacent thereto in the series and the flow section of the channel adjacent to said channel, feeding concentrated brine to the anode compartments and water to the cathode compartments, generating multiple recirculation motions of the electrolyte contained in said compartments, said recirculation motions being distributed along the entire width of the compartments as the result of different densities of gas bubbles in adjacent channels and discharging the gas and the electrolyte effluent therefrom through outlets at the top of each compartment.

2. The process of claim 1 wherein the baffles are alternately longitudinally inclined one way and the other with respect to the vertical plane normal to the separating wall thereby generating vertical flow channels with alternately upwards-decreasing and upwards-increasing cross sections.

3. The process of claim 1 wherein the baffles are alternately transversally inclined one way and the other with respect to the vertical plane normal to the separating wall thereby generating vertical flow channels with a constant section along the entire height thereof.

4. The process of claims 1, 2 or 3 wherein the baffles are made of metal and act as the current distributing means to the vertical screen electrodes.

5. A process for generating recirculation motions of electrolyte contained in an electrode compartment of a substantially vertical diaphragm cell wherein the electrode comprises a gas and liquid permeable open-mesh structure spaced apart from the vertical end plate and in a parallel relationship therewith comprising dividing the electrode compartment into a series of vertical flow channels extending for a great portion of the compartment's height with a series of baffles having a width substantially corresponding to the depth of the compartment alternately inclined one way and the opposite way with respect to the vertical plane normal to the plane of the vertical end plate and spaced apart one another whereby the ratio between the electrode surface intercepted by the edge of two baffles laterally defining a vertical flow channel and the flow section thereof is substantially different from the ratio between electrode area intercepted by the edge of one of said baffles and the edge of the other baffle adjacent in the series and the flow section of the channel adjacent to said channel, feeding electrolyte into the compartment, generating multiple recirculation motions of the electrolyte within the compartment distributed along the entire width of the compartment as the result of the different bubble desities of electrodically evolved gas in flow channel adjacent in the series, discharging the gas and the electrolyte effluent therefrom through an outlet at the top of the compartment.

6. The process of claim 5 wherein the baffles are alternately transversally inclined one way and the opposite way with respect to the vertical plane normal to the vertical terminal element of the compartment thereby generating vertical flow channels of a constant section along the entire length of the channels.

7. The process of claim 5 wherein the baffles are alternately longitudinally inclined one way and the other with respect to the vertical plane normal to the vertical terminal element of the compartment thereby generating vertical flow channels with alternately upwards-decreasing and upwards-increasing cross sections.

8. The process of claims 5, 6 or 7 wherein the baffles are made of metal and act as the current distributing means to the vertical screen electrode.

9. A method of electrolysis of an electrolyte wherein an electrolyzing voltage is imposed between a pair of vertically opposed electrolyte and gas permeable electrodes in sheet or layer form separated by an ion permeable diaphragm extending across a cell chamber and dividing the cell into cell compartments, the front face of at least one of said electrodes being in contact with the diaphragm which comprises providing upward and downward electrolyte flow respectively along adjacent rear gas evolving surfaces of said contacting electrode, said sections being laterally spaced along the width of the cell.

10. The method of claim 9 wherein the electrolyte is aqueous alkali metal chloride and chlorine bubbles are generated and collect in said upward and downward flow, said upward flow having a higher bubble density than said downward flow.

* * * * *